US005874935A

United States Patent [19]

Nishi et al.

[11] Patent Number: 5,874,935

[45] Date of Patent: Feb. 23, 1999

[54] DRIVING CIRCUIT AND ITS DRIVING METHOD FOR DISPLAY APPARATUS

[75] Inventors: Kazuyoshi Nishi, Mukou; Mamoru Seike; Jun Iitsuka, both of Takatsuki, all of Japan

[73] Assignee: Matsushita Electric Industrial Co., Ltd., Osaka, Japan

[21] Appl. No.: 744,808

[22] Filed: Nov. 6, 1996

[30] Foreign Application Priority Data

Nov. 6, 1995 [JP] Japan ..... 7-286955

[51] Int. Cl.[6] ..... G09G 3/36

[52] U.S. Cl. ..... 345/100; 345/98

[58] Field of Search ..... 345/100, 98, 204, 345/212, 94

[56] References Cited

U.S. PATENT DOCUMENTS 5,367,314 11/1994 Okada et al. ..... 345/100
5,440,323 8/1995 Okada ..... 345/100

FOREIGN PATENT DOCUMENTS 2-157815 6/1990 Japan .
6-34938 2/1994 Japan .

*Primary Examiner*—Matthew Luu
*Attorney, Agent, or Firm*—McDermott, Will & Emery

[57] ABSTRACT

A driving circuit for the display apparatus having a plurality of output terminals includes a couple of selecting parts for selecting either a potential VDD2 or a potential VDD4 by control signals 221S, 222S, 231S and 2342S and then outputting said selected potentials as V1 and V2, respectively; and a plurality of output parts: say, one of the odd numbered output parts 202 having, in common with other odd numbered output parts, potentials VDD1 and VDD3 and said selected potential V1, and selecting one potential out of them by control signal 241S, 242S and 243S and outputting said selected next potential as a driving signal; one of the even numbered output parts 203 having, in common with other even numbered output parts, said potentials VDD1 and VDD3 and said selected potential V2, and selecting one potential out of them by control signal 251S, 252S, 253S and outputting said selected next potential as a driving signal.

17 Claims, 8 Drawing Sheets

DRIVING CIRCUIT AND ITS DRIVING METHOD FOR DISPLAY APPARATUS

BACKGROUND OF THE INVENTION

1. Field of the Invention

The present invention relates to a driving circuit for a display apparatus, particularly to a driving circuit for a display apparatus with a multitude of outputs that outputs specified waveforms and is useful for scaling down the driver chip.

Various kind of driver chips generally output specified waveforms, which are formed in such a way that a plurality of power supplies associated with the respective waveforms are selected by transfer gates and then outputted.

In a driver chip with a multitude of outputs such as a liquid crystal driver, smaller output impedance is needed to obtain a larger driving capability, thus a chip area used for the above mentioned transfer gates tends to be large thus occupying a large percentage of the whole chip area.

Furthermore, recently, as the screen of liquid crystal displays have become wider, driving load requirements have become larger. This necessitates even smaller output impedance, thus the transfer gates will occupy an even greater percentage of the whole chip area.

On the other hand, the reduced chip area of a driving circuit has continuously been sought and crucial to realize even lower price.

For reference purposes, a liquid crystal display apparatus as disclosed in the Japanese Patent Open-Laying No. Hei 2-157815 will be explained below.

FIG. 5 is a circuit diagram of the liquid crystal display apparatus. Elements 4, 8 and 12 are liquid crystal elements, 1 is a video signal line for controlling the twist of the liquid crystal elements 4, 8 and 12 and so on. Elements 3, 7 and 11 are thin film transistors (hereafter referred to as TFT's) for controlling the transfer of a video signal in the video signal line 1 to the liquid crystal elements 4, 8 and 12. Elements 2, 6, and 10 are scanning signal lines for turning on or off TFT's 3, 7 and 11. Elements 5, 9 and 13 are storage capacitors for storing charge.

It should be noted that FIG. 5 illustrates only part of the liquid crystal display apparatus. In accordance with resolution of the display apparatus, a specified number of combinations of a TFT, a liquid crystal element and a storage capacitor are actually arrayed vertically and horizontally, and a specified number of video signal lines and scanning signs lines are also disposed.

FIG. 6 shows the waveforms of scanning signals used in the liquid crystal display apparatus of FIG. 5. A scanning signal 2S comes in a scanning signal line 2, a scanning signal 6S in a scanning signal line 6 and a scanning signal 10S in a scanning signal line 10.

This liquid crystal display apparatus features the presence of the storage capacitors 5, 9 and 13, and as a result of a stored charge on the storage capacitors 5, 9 and 13 an even smaller amplitude of a video signal on the video signal line 1 is usable, thereby helping decreasing power consumption.

The performance of the liquid crystal display apparatus will be explained below in detail.

During t1, scanning signals 2S, 6S and 10S as respectively inputted to the scanning signal lines 2, 6 and 10 turn off the respective TFT's 3, 7 and 11.

During t2, the scanning signal 2S inputted to the scanning signal line 2 turns on the TFT 3, but the amplitude of a video signal on the video signal line 1 is too small to activate the liquid crystal element 4, and the voltage on the video signal line 1, which is to be used to activate the liquid crystal element 4, is applied to the storage capacitor 5, producing a potential difference between the terminals of the storage capacitor 5.

During t3, the scanning signal 2S inputted to the scanning signal line 2 turns off TFT 3.

During t4, the scanning signal 6S inputted to the scanning signal line 6 turns on TFT 7, but the amplitude of the video signal on the video signal line 1 is too small to activate the liquid crystal element 8, and the voltage on the video signal line 1, which is to be used to activate the liquid crystal element 8, is applied to the storage capacitor 9, producing a potential difference between the terminals of the storage capacitor 9.

During t5, the scanning signal 6S inputted to the scanning signal line 2 turns off TFT 7.

During t6, the scanning signal 2S inputted to the scanning signal line 2 activates and twists the liquid crystal element 8.

In more detail, as the potential of the scanning signal line 2 is increased, the potential of the liquid crystal element 8 is increased to the sum of the potential of the scanning signal line 2 and the potential difference (namely, the voltage of the video signal line 1 as stored) between the terminals of the storage capacitor 9. For this reason, even a small amplitude of the video signal on the video signal line 1 is able to activate the liquid crystal element 8.

However, unless TFT 7 is turned off at this time, charge stored in the storage capacitor 9 would discharge to the video signal line 1. For this reason, a time interval t5 is provided so that the potential of the scanning signal line 2 is to be increased after TFT 7 is turned off.

During t6, when the scanning signal 10S is inputted to the scanning signal line 10, the video signal on the video signal line 1 is stored in the storage capacitor 13. Here it should be noted that this video signal on the video signal line 1 is of inverse polarity to that stored in the storage capacitor 9.

During t7, the scanning signal 10S inputted to the scanning signal line 10 turns off TFT 11.

During t8, the scanning signal 6S inputted to the scanning signal line 6 activates and twists the liquid crystal element 12.

In more detail, as the potential of the scanning signal line 6 is lowered, the potential of the liquid crystal element 12 is decreased to the sum of the potential of the scanning signal line 6 and the potential difference between the terminals of the storage capacitor 13. For this reason, even a small voltage amplitude of the video signal on the video signal line 1 is able to activate the liquid crystal element 12. In this case the liquid crystal element 12 twists in the inverse direction against the liquid crystal element 8.

The above mentioned operations are to be repeated until the n-th scanning signal is generated (not shown in FIG. 6), thereby displaying one image on the liquid crystal display apparatus.

If liquid crystal is being twisted in one direction for a long time, a burning effect would occur. Therefore, even when displaying the same image the direction of twisting needs to be incessantly and completely inverted. The performance for twisting liquid crystal in the inverse direction will be explained below.

During t12, the scanning signal 2S inputted to the scanning signal line 2 turns on TFT 3, but the voltage amplitude of a video signal inputted to the video signal line 1 is too small to activate the liquid crystal element 4. However, the voltage of the video signal line 1 which is to be used to activate the liquid crystal element 4 is applied to the storage capacitor 5, thereby producing the potential difference between the terminals of the storage capacitors 5. Here, during t2, the voltage of the video signal line 1 is of opposite polarity to that applied to the storage capacitor 5.

During t13, the scanning signal 2S inputted to the scanning signal line 2 turns off TFT 3.

During t14, the scanning signal 6S inputted to the scanning signal line 6 turns on TFT 7, but the voltage amplitude of a video signal on the video signal line 1 is too small to activate the liquid crystal element 8. However, the voltage of the video signal line 1 which is to be used for activating the liquid crystal element 8 is applied to the storage capacitor 9, thereby producing the potential difference between the terminals of the storage capacitor 9. Here it should be noted that during t14, the potential of the video signal line 1 is of opposite polarity to that applied to the storage capacitor 9.

During t15, the scanning signal 6S inputted to the scanning signal line 6 turns off TFT 7.

During t16, when the scanning signal 2S is inputted to the scanning signal line 2, the liquid crystal element 4 is activated and twisted.

In more detail, as the potential of the scanning signal 2S is lowered, the potential of the liquid crystal element 8 is decreased to the sum of the potential of the scanning signal line 2 and the potential difference between the terminals of the storage capacitor 9. For this reason, even a small voltage amplitude of the video signal on the video signal line 1 is able to activate the liquid crystal element 8.

However, unless TFT 7 is turned off at this time, charge stored in the storage capacitor 9 would discharge via the video signal line 1. For this reason, a time interval t15 is provided so that after TFT 7 is turned off the potential of the scanning signal line 2 is decreased. During t13, when the scanning signal 10S is inputted to the scanning signal line 10, the voltage of the video signal line 1 is stored in the storage capacitor 13. Here it should be noted that the potential of the video signal line 1 is of opposite polarity to that applied to the storage capacitor 13.

During t17, the scanning signal 10S inputted to the scanning signal line 10 turns off TFT 11.

During t18, the scanning signal 6S inputted to the scanning signal line 6 activates and twists the liquid crystal element 12.

In more detail, as the potential of the video signal 6 is increased, the potential of the liquid crystal element 12 is decreased to the sum of the potential of the scanning signal line 6 and the potential difference between the terminals of the storage capacitor 13. For this reason, even a small voltage amplitude of the video signal on the video signal line 1 is able to activate the liquid crystal element 12.

The above mentioned operations are to be repeated until the n-th scanning signal is generated (not shown in FIG. 6), thereby twisting in the inverse direction all liquid crystal elements in the liquid crystal display apparatus.

2. Description of the Prior Art

As described above, this liquid crystal display apparatus intends to reduce power consumption by making use of charge stored in the storage capacitors 5, 9 and 13, and for this purpose a driving circuit that outputs the waveforms as shown in FIG. 6 is needed.

Referring to FIG. 6, a conventional driving circuit that outputs the waveforms as shown in FIG. 6 for the liquid crystal display apparatus will be explained.

FIG. 7 is a circuit diagram of a conventional driving circuit with n pieces of output terminals for the liquid crystal display apparatus.

In FIG. 7, 30 and 31 are P-type MOS transistors, 32 to 34 are N-type MOS transistors, 35 and 36 are inverter circuits for inverting an input signal, 50 to 53 are control signal lines for turning on or off transistors 30, 31, 32, 33 and 34. 45 is an output terminal for outputting a driving signal into the scanning signal line 2 in the liquid crystal display apparatus as shown in FIG. 5. 40 to 43 are potential supply lines for supplying potentials to the output terminals when the respective transistors 30, 31, 32, 33, 34, 60 and so on, are in the on-state, 40 is an on potential line for supplying a TFT in the liquid crystal display apparatus with an on potential VDD1, 41 and 42 are storage potential lines for supplying a storage capacitor with respective potentials VDD2 and VDD4 to store charge, and 43 is an off potential line for supplying a TFT with an off potential VDD3.

Here, the following relationship holds: VDD1>VDD2>VDD3>VDD4>=VSS.

60 and 61 are P-type MOS transistors, 62 to 64 are N-type MOS transistors, 65 and 66 are inverter circuits for inverting an input signal, 70 to 73 are control signal lines for turning on or off transistors 60, 61, 62, 63 and 64. 75 is an output terminal for outputting a driving signal into the scanning signal line 6 in the liquid crystal display apparatus as shown in FIG. 5.

FIG. 8 is a timing chart of a driving circuit for the liquid crystal display apparatus, where 50S to 53S and 70S to 73S show input waveforms on the control signal lines 50 to 53 and 70 to 73, respectively, and 45S and 75S are output waveforms from the output terminals 45 and 75, respectively, as shown in FIG. 7.

The operation of the driving circuit for the liquid crystal display apparatus as shown in FIG. 7 will be explained, referring to FIG. 8.

During t1, when control signals 50S to 53S are inputted to control signal lines 50 to 53, respectively, as the control signal 53S has a voltage level "1", the N-type MOS transistor 34 is turned on, then the off potential on the off potential line 43 is outputted from the output terminal 45, namely, a driving signal 45S is outputted from the output terminal 45.

On the other hand, when control signals 70S to 73S are inputted to the control signal lines 70 to 73, respectively, as the control signal 73S has a voltage level "1", the N-type MOS transistor 64 is turned on, then the off potential on the off potential line 43 is outputted from the output terminal 75, namely, a driving signal 75S is outputted from the output terminal 75.

During t2, when the control signals 50S to 53S are inputted to the control signal lines 50 to 53, respectively, as the control signal 50S has a voltage level "1", the P-type MOS transistor 30 is turned on, then the on potential on the on potential line 40 is outputted from the output terminal 45. (Refer to the waveform of the driving signal 45S from the output terminal 45 in FIG. 8).

On the other hand, even when the control signals 70S to 73S are inputted to the control signal lines 70 to 73, respectively, as the control signal 73S retains a voltage level "1", the off potential on the off potential line 43 is outputted from the output terminal 75. (Refer to the driving signal 75S from the output terminal 75 in FIG. 8).

During t3, when the control signals 50S to 53S are inputted to the control signal lines 50 to 53, respectively, as the control signal 52S has a voltage level "1", the N- MOS transistor 33 is turned on, then the storage potential VDD4 on the storage potential line 42 is outputted from the output terminal 45. (Refer to the waveform of the driving signal 45S from the output terminal 45 in FIG. 8).

On the other hand, when the control signals 70S to 73S are inputted to the control signal lines 70 to 73, respectively, as the control signal 73S retains a voltage level "1", then the off potential on the off potential line 43 is outputted from the it output terminal 75. (Refer to the waveform of the driving signal 75S from the output terminal 75 in FIG. 8).

During t4, even when the control signals 50S to 53S are inputted to the control signal lines 50 to 53, respectively, as the control signal 52S retains a voltage level "1", the storage potential VDD4 on the storage potential line 42 is outputted from the output terminal 45. (Refer to the waveform of the driving signal 45S from the output terminal 45 in FIG. 8).

On the other hand, when the control signals 70S to 73S are inputted to the control signal lines 70 to 73, respectively, as the control signal 70S has a voltage level "1", the P-type MOS transistor 60 is turned on, then the on potential on the on potential line 40 is outputted from the output terminal 75. (Refer to the waveform of the driving signal 75S from the output terminal 75 in FIG. 8).

During t5, when the control signals SOS to 53S are inputted to the control signal lines 50 to 53, respectively, as the control signal 52S retains a voltage level "1", then the storage potential VDD4 on the storage potential line 42 is outputted from the output terminal 45. (Refer to the waveform of the driving signal 45S from the output terminal 45 in FIG. 8).

On the other hand, when the control signals 70S to 73S are inputted to the control signal lines 70 to 73, respectively, as the control signal 71 has a voltage level "1", a CMOS transistor comprising the P-type MOS transistor 61 and the N-type MOS transistor 62 is turned on, then the storage potential VDD2 on the storage potential line 41 is outputted from the output terminal 75. (Refer to the waveform of the driving signal 75S from the output terminal 75 in FIG. 8).

During t6, when the control signals 50S to 53S are inputted to the control signal lines 50 to 53, as the control signal 53S has a voltage level "1", the off potential on the off potential line 43 is outputted from the output terminal 45. (Refer to the waveform of the driving signal 45S from the output terminal 45 in FIG. 8).

On the other hand, even when the control signals 70S to 73S are inputted to the control signal lines 70 to 73, respectively, as the control signal 71S retains a voltage level "1", the storage potential VDD2 on the storage potential line 41 is outputted from the output terminal 75. (Refer to the waveform of the driving signal 75S from the output terminal 75 in FIG. 8).

During t7, even when the control signals 50S to 53S are inputted to the control signal lines 50 to 53, respectively, as the control signal 53S has a voltage level "1", the off potential on the off potential line 43 is outputted from the output terminal 45. (Refer to the waveform of the driving signal 45S from the output terminal 45 in FIG. 8).

On the other hand, when the control signal 70S to 73S are inputted to the control signal lines 70 to 73, respectively, as the control signal 71S has a voltage level "1", the storage potential VDD 2 on the storage potential line 41 is outputted from the output terminal 75. (Refer to the waveform of the driving signal 75S from the output terminal 75).

The above mentioned operations are to be repeated up until the n-th output terminal (not shown in FIG. 7), thereby outputting the scanning signals for displaying one image in the liquid crystal display apparatus.

Next, liquid crystal in the liquid crystal display apparatus is twisted in the inverse direction to avoid a burning effect in the following manner.

During t12, when the control signals 50S to 53S are inputted to the control signal lines 50 to 53, respectively, as the control signal 50S has a voltage level "1", the P-type MOS transistor 30 is turned on, then the on potential on the on potential line 40 is outputted from the output terminal 45. (Refer to the waveform of the driving signal 45S from the output terminal 45 in FIG. 8).

On the other hand, even when the control signals 70S to 73S are inputted to the control signal lines 70 to 73, respectively, as the control signal 73S has a voltage level "1", the off potential on the off potential line 43 is outputted from the output terminal 75. (Refer to the waveform of the driving signal 75S from the output terminal 75 in FIG. 8).

During t13, when the control signals 50S to 53S are inputted to the control signal lines 50 to 53, respectively, as the control signal 51S has a voltage level "1", a CMOS transistor comprising the P-type MOS transistor 31 and the N-type MOS transistor 32 is turned on, then the storage potential VDD2 on the storage potential line 41 is outputted from the output terminal 45. (Refer to the waveform of the driving signal 45S from the output terminal 45 in FIG. 8).

On the other hand, even when the control signals 70S to 73S are inputted to the control signal lines 70 to 73, respectively, as the control signal 73S retains a voltage level "1", then the off potential on the off potential line 43 is outputted from the output terminal 75. (Refer to the waveform of the driving signal 75S from the output terminal 75 in FIG. 8).

During t14, even when the control signals 50S to 53S are inputted to the control signal lines 50 to 53, respectively, as the control signal 51S retains a voltage level "1", the storage potential VDD2 on the storage potential line 41 is outputted from the output terminal 45. (Refer to the wave form of the driving signal 45S from the output terminal 45 in FIG. 8).

On the other hand, when the control signals 70S to 73S are inputted to the control signal lines 70 to 73, respectively, as the control signal 70S has a voltage level "1", the P-type MOS transistor 60 is turned on, then the on potential on the on potential line 40 is outputted from the output terminal 75. (Refer to the waveform of the driving signal 75S from the output terminal 75 in FIG. 8).

During t15, even when the control signals 50S to 53S are inputted to the control signal lines 50 to 53, respectively, as the control signal 51S retains a voltage level "1", then the storage potential VDD2 on the storage potential line 41 is outputted from the output terminal 45. (Refer to the waveform of the driving signal 45S from the output terminal 45 in FIG. 8).

On the other hand, when the control signals 70S to 73S are inputted to the control signal lines 70 to 73, respectively, as the control signal 72S has a voltage level "1", the N-type MOS transistor 63 is turned on, then the storage potential VDD4 on the storage potential line 42 is outputted from the output terminal 75. (Refer to the driving signal 75S from the output terminal 75 in FIG. 8).

During t16, when the control signals 50S to 53S are inputted to the control signal lines 50 to 53, respectively, as the control signal 53S has a voltage level "1", the N-type MOS transistor 34 is turned on, then the off potential VDD3 on the off potential line 43 is outputted from the output terminal 45. (Refer to the waveform of the driving signal 45S in FIG. 8).

On the other hand, even when the control signal 70S to 73S are inputted to the control signal lines 70 to 73, respectively, as the control signal 72S has a voltage level "1", the storage potential VDD4 on the storage potential line 42 is outputted from the output terminal 75. (Refer to the waveform of the driving signal 75S from the output terminal 75 in FIG. 8).

During t17, even when the control signals 50S to 53S are inputted to the control signal lines 50 to 53, respectively, as the control signal 53S has a voltage level "1", the off potential on the off potential line 43 is outputted from the output terminal 45. (Refer to the waveform of the driving signal 45S from the output terminal 45 in FIG. 8).

On the other hand, when the control signal 70S to 73S are inputted to the control signal lines 70 to 73, respectively, as the control signal 72S has a voltage level "1", the storage potential VDD4 on the storage potential line 42 is outputted from the output terminal 75. (Refer to the waveform of the driving signal 75S from the output terminal 75).

The above mentioned operations are to be repeated up until the n-th output terminal (not shown in FIG. 7), thereby outputting the scanning signals for displaying one image in the liquid crystal display apparatus.

SUMMARY OF THE INVENTION

The conventional driving circuit as described above, however, needs five transistors and two inverters for outputting one scanning signal, that is, nine transistors as a whole since an inverter comprises two transistors.

Therefore, as the number of output terminals increases, the number of transistors increases, resulting in a large chip area being required for the driving circuit.

Furthermore, the recent demand toward the large screen for the liquid crystal display apparatus tends to increase the number of outputs in the driving circuit, and thereby further increases the necessary chip area.

The object of the present invention is to solve the above mentioned problems, and to provide a driving circuit that occupies less chip area by reducing the number of transistors by means of the common use of transistors.

The driving circuit according to the present invention comprises m pieces of selecting parts, each selecting and outputting one potential out of i pieces of potential with control signals, and n pieces of output parts, each selecting and outputting one potential out of the sum (j+1) of the potential as selected in said selecting parts, namely, in such a way that in the selecting parts one potential is selected beforehand out of i pieces of potentials and thereafter in the output parts one potential is selected out of the sum (1+j) of, the potential as selected in the selecting parts and j pieces of other potentials that are to be outputted at different timings from the output parts.

The conventional driving circuit, therefore, needs (i+j) pieces of transfer gates for one output or scanning signal. On the contrary, the driving circuit according to the present invention needs only (1+j) pieces of transfer gates for one output or scanning signal (namely, save i−1, and i is most likely more than 2), thereby decreasing transistor count as a whole and helping reduce the necessary chip area.

It should be noted that in the driving circuit according to the present invention there is an overhead of transistors included in the selecting parts, but a multitude of output parts substantially nullifies this transistor count.

DETAILED DESCRIPTION OF THE PRESENT INVENTION

Figure 1:
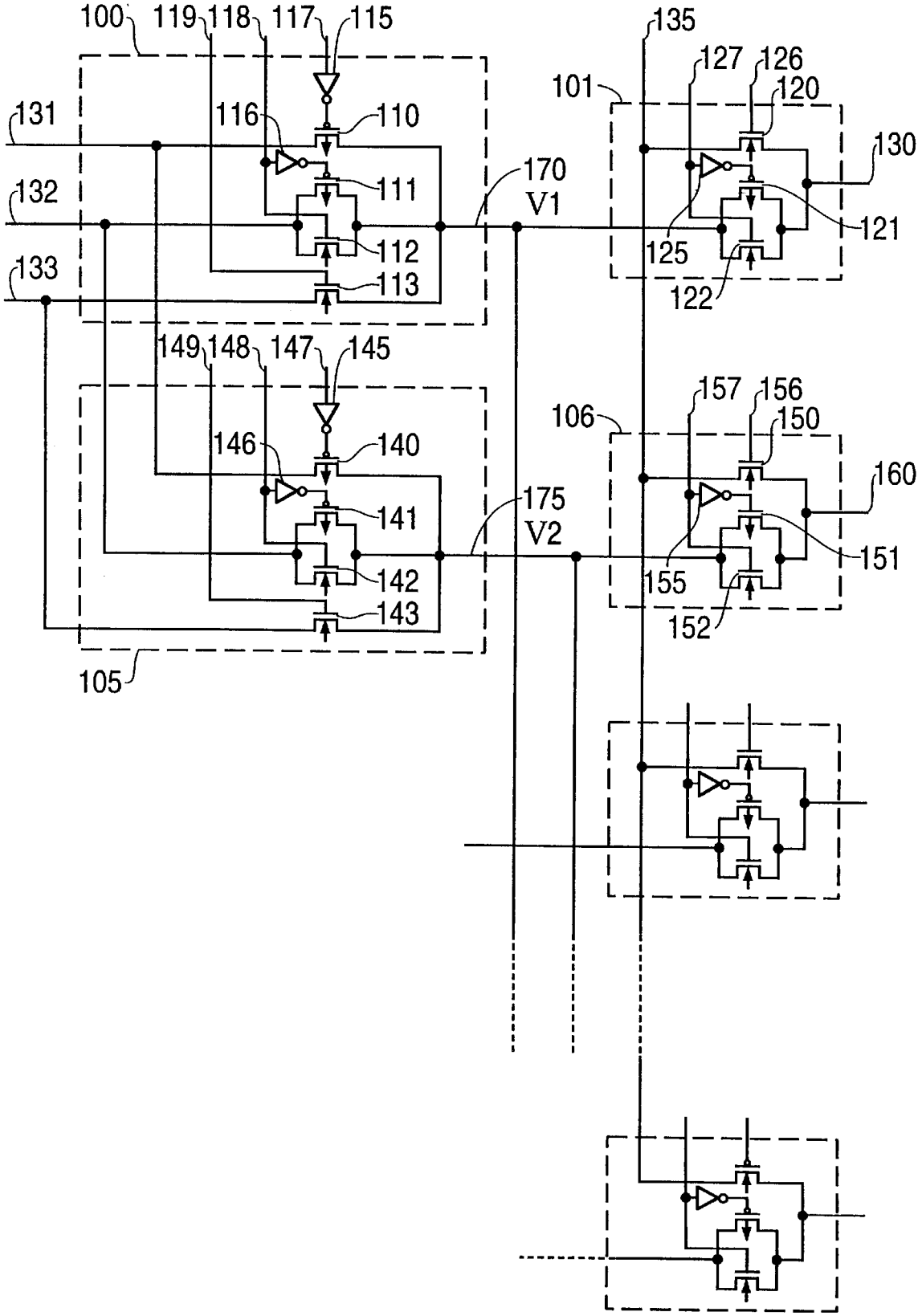
FIG. 1 shows a driving circuit realized by the first embodiment of the present invention.

The preferred embodiments of the present invention will be explained below, referring to the drawings.

1. The First Embodiment

The principle applied to the first embodiment of the present invention will be explained.

A novel liquid crystal driving circuit that outputs a multitude of signals that are identical in shape but shifted in time from one signal to next can be realized;

by dividing the driving circuit to a common-use selecting part and a multitude of output parts;

wherein each of the potentials to be eventually outputted at different times with one another from the output parts are able to be selected in the common-use selecting parts, while potentials to be eventually outputted at the same time from the output parts have to be selected in the respective output part and outputted therefrom;

thus, by selecting and then outputting as many potentials as possible in the common-use selecting parts, simplifying each of the multitude of output parts.

In other words, the simplification of the driving circuit according to the first embodiment of the present invention is achieved on the basis that "a primary waveform is produced in the common selecting part, and is thereafter cut down in each of the multitude of output parts."

According to the first embodiment of the invention, the driving circuit for the display apparatus comprises;

m pieces of selecting parts, each selecting one potential out of i pieces of potentials by control signals; and n pieces of output parts, each thereby selecting one potential out of the potential as outputted from said selecting parts and j pieces of other potentials namely, (1+j); said i pieces of potentials being outputted at different times with one another from said output terminals;

wherein in said selecting parts one potential is selected beforehand out of i pieces of potentials that are to be outputted at different times from said output parts; and in said output parts one potential is selected out of the sum (1+j) of the potential as selected in said selecting parts and j pieces of other potentials.

The conventional driving circuit, therefore, needs (i+j) pieces of transfer gates for one driving signal, while the driving circuit according to the present invention needs only (1+j) pieces of transfer gates, in the respective output parts, resulting in saving (i−1) gates and making smaller the chip area.

It should be noted that although the present invention needs extra selecting parts compared to the prior art, the selecting parts are in common use for much more of the output parts than the driving gates, thus neglecting the number of transfer gates included in the selecting parts for one driving signal.

According to another aspect of the present invention, the driving circuit for the display apparatus having n pieces of output terminals each for outputting a driving signal comprising a plurality of potentials is characterized in that;

one potential is selected out of potentials that are to be outputted at different times between anyone of said n pieces of output terminals and the others; and thereafter one potential is selected out of; said selected potential and the potential that is outputted next to potentials to be outputted at the same time between anyone of said n pieces of output terminals and others, and then outputted from said n pieces of output terminals.

In other words, by selecting one potential beforehand out of potentials to be outputted at different times between any one of said n pieces of output terminals and the others, the number of potentials to be selected in the output parts is decreased, thereby helping make smaller the number of transfer gates in the output parts.

According to another aspect of the present invention, the driving circuit for the display apparatus having n pieces of output terminals each for outputting a driving signal comprising a plurality of potentials, wherein;

one potential is selected out of potentials that are to be outputted at different times between anyone of said n pieces of output terminals and the others, excluding the potential that is to be outputted next to the potential to be outputted at the same time between anyone of said n pieces of output terminals and others;

and thereafter one potential is selected out of said selected potential, potentials that are to be outputted at the same time between anyone of said n pieces of output terminals and others, and potentials that are to be outputted next to the potential to be outputted at the same time between anyone of said n pieces of output terminals, thereby being outputted from said n pieces of output terminals.

In other words, by selecting one potential beforehand out of potentials that are to be outputted at different times between anyone of said n pieces of output terminals and the others, the number of potentials selected in the output parts is decreased, thus not only helping decrease the number of transistors in the output parts, but also permitting large allowances for timing lags in the control signals, resulting in stable operation of the driving circuit.

FIG. 1 shows a driving circuit for the liquid crystal display apparatus with n pieces of output terminals according to the first embodiment of the present invention, comprising a couple of selecting parts 100 and 105 and n pieces of output parts 101, 106 and so on.

The supply potentials VDD1, VDD2, VDD3, VDD4 and VSS used in this embodiment hold the following relationship; VDD1>VDD2>VDD3>VDD4>=VSS. Elements 131, 132, 135 and 133 are potential supply lines for potentials VDD1, VDD2, VDD3 and VDD4, respectively.

The first selecting part 100 comprises; potential supply lines 131, 132 and 133, control signal lines 117, 118 and 119, P-channel MOS transistors 110 and 111, N-channel MOS transistors 112 and 113, inverters 115 and 116, and a selecting-part output line 170. Here the P-channel MOS transistor 111 and the N-channel MOS transistor 112 are combined together to form a complementary circuit, what is called a CMOS structure.

In the similar way, the second selecting part 105 comprises; potential supply lines 131, 132 and 133 that are in common use with the selecting part 100, control signal lines 147, 148 and 149, P-type MOS transistors 140 and 141, N-type MOS transistors 142 and 143, inverters 145 and 146, and a selecting-part output line 175. Here the P-type MOS transistor 141 and the N-type MOS transistor 142 are combined together to form a complementary circuit, what is called a CMOS structure.

In this embodiment, the potential of the driving potential line 131 is 20 V, that of the storage potential line 132 is 15 V, that of the off potential line 135 is 10 V, and that of the storage potential line 133 is 5 V.

For this reason, the P-type MOS transistor 110, the CMOS structure comprising the P-type MOS transistor 111 and the N-type MOS transistor 112, and the N-type MOS transistor 113 are used to reduce on-resistance. In other words, when values are diverse between driving potential, storage potentials, and off potential, appropriate transistors should be used.

The potentials VDD1, VDD2 and VDD4 are, as will be later described, to be outputted from the output terminals at different times with one another. Namely, only potentials that are outputted from the output terminals at different times with one another should be in common use for being inputted to a couple of selecting parts.

The operations of the selecting parts according to the first embodiment will be explained below.

In the selecting part 100, by a control signal applied to the control signal line 117 the potential VDD1 on the potential supply line 131 is outputted as a selecting-part output potential V1 to the selecting-part output line 170, by a control signal applied to the control signal line 118 the potential VDD2 on the potential supply line 132 is outputted as a selecting-part output potential V1 to the selecting-part output line 170, and by a control signal applied to the control signal line 119 the potential VDD4 on the potential supply line 133 is outputted as a selecting-part output potential V1 to the selecting-part output line 170.

In the similar way, in the selecting part 105, by a control signal applied to the control signal line 147 the potential VDDl on the potential supply line 131 is outputted as a selecting-part output potential V2 to the selecting-part output line 175, by a control signal applied to the control signal line 148 the potential VDD2 on the potential supply line 132 is outputted as a selecting-part output potential V2 to the selecting-part output line 175, and by a control signal applied to the control signal line 149 the potential VDD4 on the potential supply line 133 is outputted as a selecting-part output potential V2 to the selecting-part output line 175

Next, the configuration of the output parts according to the first embodiment will be explained.

The circuit configuration of the n-pieces of output parts each for outputting a driving signal are identical with one another, as shown in FIG. 1, so that only the configurations of the first (odd-numbered) and the second (even-numbered) output parts, 101 and 106, will be explained and the explanation about the other output parts will be omitted.

The odd-numbered output part 101 comprises the output line 170 from the selecting part 100, a potential supply line 135, control signal lines 126 and 127, P-type MOS transistor 121, an N-type MOS transistor 120, 122, an inverter 125, and an output terminal 130 for outputting a driving signal. Here, the P-type MOS transistor 121 and the N-type MOS transistor 122 are combined together to form a complimentary circuit called CMOS.

The even-numbered output part 106 comprises the output line 175 from the selecting part 105, a potential supply line 135, control signal lines 156 and 157, the P-type MOS transistor 151, N-type MOS transistors 150 and 152, an inverter 155, and an output terminal 160 for outputting a driving signal. Here, the P-type MOS transistor 151 and the N-type MOS transistor 152 are combined together to form a complimentary circuit called CMOS.

In the same manner, the remaining odd-numbered output parts have an input potential from the output line 170 of the selecting part 100, while the remaining even-numbered output parts have an input potential from the output line 175 of the selecting part 105.

A potential VDD3 is applied to the potential supply line 135 which is in common use for both even-numbered and odd-numbered output parts. The potential VDD3 is to be outputted from the output terminal at the same time as potentials selected in the selecting part. Namely, a potential (in case of FIG. 1, VDD3), which is to be outputted from the output terminal at the same time as potentials selected in the selecting parts, and potential as selected in the selecting part (in case of FIG. 1, VDD1, VDD2 and VDD4)are common input potentials to each of the output parts.

The operation of the output part according to the first embodiment of the present invention will be explained.

In the output part 101, with the aid of the control signal line 126 a potential VDD3 on the potential supply line 135 is outputted as a driving signal from the output terminal 130, and with the aid of the control signal line 127 an output potential V1 of the selecting part 100 is outputted as a driving signal from the output terminal 130.

In the same manner, in the output part 106, with the aid of the control signal line 156 a potential VDD3 on the potential supply line 135 is outputted as a driving signal from the output terminal 160, and with the aid of the control signal line 157 an output potential V2 from the selecting part 105 is outputted from the output terminal 160.

In the same manner as described above, the odd-numbered output parts serve as outputting an output potential V1 from the selecting part 100 and VDD3 as a driving signal from the output terminal, while the even-numbered output parts serve as outputting an output potential V2 from the selecting part 105 and VDD3 as a driving signal from the output terminal.

As is clear from the above description, each of the output terminals could not output either VDD1, VDD2 or VDD4 simultaneously with any other output terminal, but can do it at different times from the others. on the other hand, VDD3 can be outputted at the same time as VDD1, VDD2 and VDD4. The output part can select and output either VDD3 or one as selected out of VDD1, VDD2 and VDD4.

Next, the operation of a liquid crystal driving circuit according to the first embodiment of the present invention will be explained with reference to FIGS. 1 and 2, in sequence from one frame to the next frame.

Figure 2:
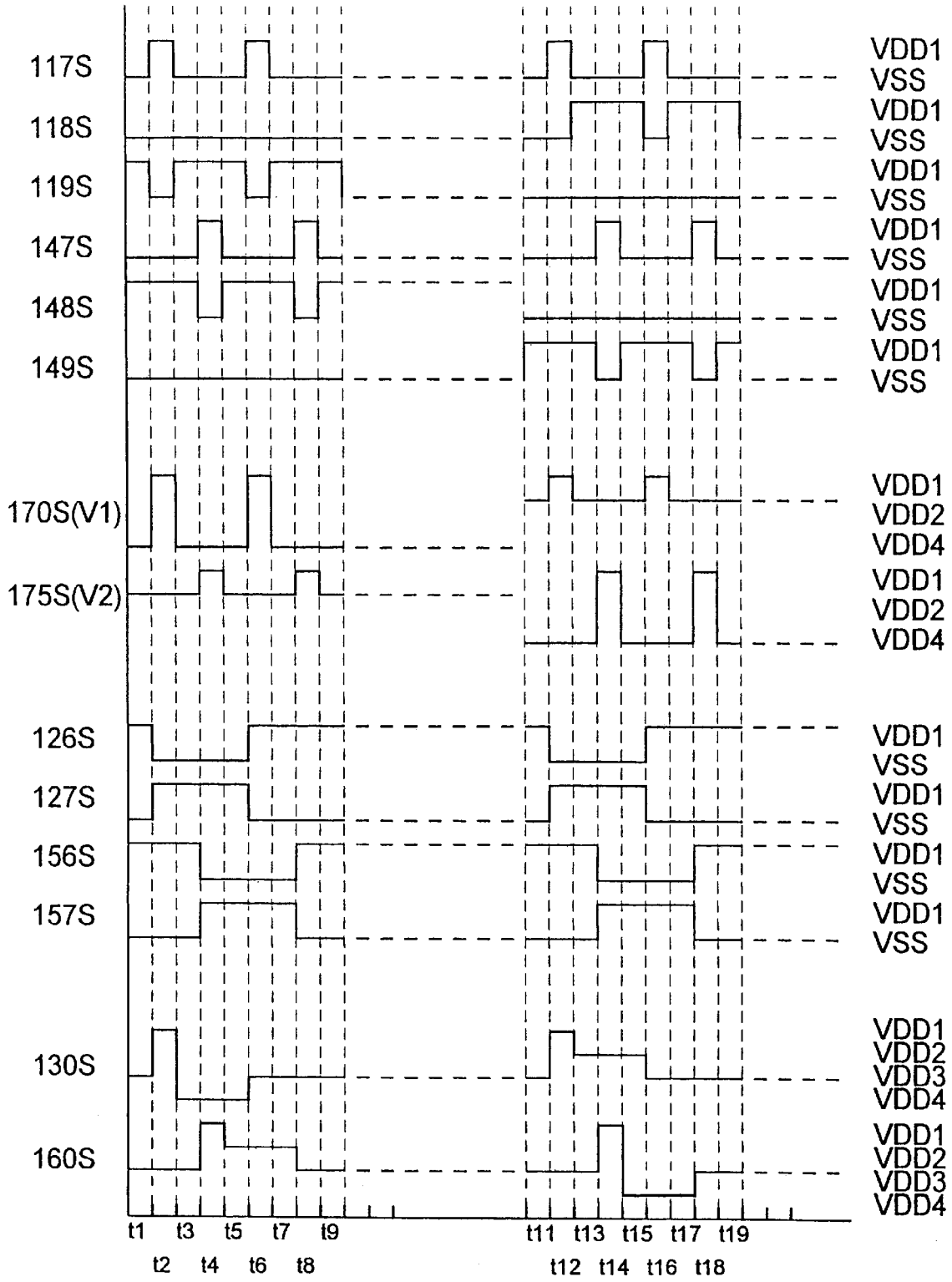
FIG. 2 is a timing chart for signals in a driving circuit of FIG. 1, realized by the first embodiment of the present invention.

FIG. 2 is a timing chart for signals in a driving circuit according to the first embodiment of the present invention as shown in FIG. 1; wherein 117S to 119S denote control signals to be applied to the control signal lines 117 to 119, respectively, of the first selecting part 100; 147S to 149S denote control signals to be applied to the control signal lines 147 to 149, respectively, of the second selecting part 105; 170S (V1) and 175S (V2) denote output signals to the selecting-part output lines 170 and 175 of FIG. 1, respectively; 126S and 127S denote control signals to be applied to the control lines 126 and 127, respectively, of the output part 101; 156S and 157S denote control signals to be applied to the control signal lines 156 and 157, respectively, of the output part 106; and 130S and 160S driving signals to be outputted from the output terminals 130 and 160, respectively.

During t1, when the control signals 117S to 119S are inputted to the control signal lines 117 to 119, respectively, as the control signal 119S has a voltage level "1", the N-type MOS transistor 113 is turned on, then the first selecting part 100 outputs the storage potential VDD4 as a selecting-part output potential V1 to the first selecting-part output line 170.

Next, when the control signals 126S and 127S are inputted to the control signal lines 126 and 127, respectively, as the control signal 126S has a voltage level "1", the N-type MOS transistor 120 is turned on, then the output part 101 outputs the off potential VDD3. This results in the waveform as indicated 130S in FIG. 2.

It should be noted that when the control signal 126S has a voltage level "1" and the control signal 127S has a voltage level "0", any signal coming from the selecting part does not have an effect on the output signal from the output part 101. However, if the selecting part 100 does not continue to output any signal, the potentials are unstable, thereby producing noise. For this purpose, as described in this embodiment, the control signals 117S to 119S should be managed to output some signals from the selecting part 100 at all times.

On the other hand, when the control signals 147S to 149S are inputted to the control signal lines 147 to 149, respectively, as the control signal 148S has a voltage level "1", the CMOS transistor of the second selecting part 105 is turned on, then the selective part 105 outputs the storage potential VDD2 as a selecting-part output potential V2 to the second selecting-part output line 175.

Next, when the control signals 156S and 157S are inputted to the control signal lines 156 and 157, respectively, as the control signal 156S has a voltage level "1", the N-type MOS transistor 150 is turned on, then the output part 106 outputs the off potential VDD3. This results in the waveform as indicated 160S.

It should be noted that, as previously described, for the same reason for the case that the control signal 126S has "1" and the control signal 127S has "0", even when the control signal 156S has "1" and the control signal 157S has "0", the control signals 147S to 149S should be managed to output some signals from the selecting part 106 at all times.

During t2, when the control signals 117S to 119S are inputted to the control signal lines 117 to 119, respectively, as the control signal 117S has a voltage level "1", the P-type MOS transistor 110 is turned on, then the selecting part 100 outputs the driving potential VDD1 to the first selecting-part output line 170.

Next, when the control signals 126S and 127S are inputted, as the control signal 127S has a voltage level "1", the CMOS transistor of the output part 101 is turned on, then the output part 101 outputs the driving potential VDD1 as selected in the selecting part 100. This results in the waveform as indicated 130S in FIG. 2.

On the other hand, when the control signals 147S to 149S are inputted to the control signal lines 147 to 149, as the control signal 148S retains a voltage level "1", the selecting part 105 continues to output the storage potential VDD2 to the second selecting-part output line 175.

As the control signal 156S also retains a voltage level "1", the output part 106 continues to output the off potential VDD3 from the output terminal 160.

During t3, when the control signals 117S to 119S are inputted to the control signal lines 117 to 119, respectively, as the control signal 119S has a voltage level "1", the N-type MOS transistor 113 is turned on, then the selecting part 100 outputs the storage potential VDD4 to the selecting-part output line 170.

Next, when the control signals 126S and 127S are inputted to the control signal lines 126 and 127, as the control signal 127S has a voltage level "1", the CMOS transistor of the output part 101 is turned on, then the output part 101 outputs the storage potential VDD4 as selected in the selecting-part 100 to the output line 130. This results in the waveform as indicated 130S in FIG. 2.

On the other hand, even when the control signals 147S to 149S are inputted to the control signal lines 147 to 149, respectively, as the control signal 148S retains a voltage level "1", the selecting part 105 outputs the storage potential VDD2 to the selecting-part output line 175.

Next, even when the control signals 156S and 157S are inputted to the control signal lines 156 and 157, respectively, as the control signal 156S has a voltage level "1", the output part 106 outputs the off potential VDD3. This results in the waveform as indicated 160S in FIG. 2.

During t4, when the control signals 117S to 119S are inputted to the control signal lines 117 to 119, respectively, as the control signal ll9S has a voltage level "1", the N-type MOS transistor 113 is turned on, then the selecting part 100 outputs the storage potential VDD4 to the selecting-part output line 170.

Next, when the control signals 126S and 127S are inputted to the control signal lines 126 and 127, respectively, as the control signal 127S has a voltage level "1", the N-type MOS transistor 122 is turned on, then the output part 101 outputs the storage potential VDD4 as selected in the selecting part 100 from the output terminal 130. (Refer to the waveform as indicated 130S in FIG. 2).

On the other hand, when the control signals 147S to 149S are inputted to the control signals 147 to 149, respectively, as the control signal 147S has a voltage level "1", the P-type MOS transistor 140 is turned on, then the selecting part 105 outputs the driving potential VDD1 to the selecting-part output line 175.

Next, when the control signals 156S and 157S are inputted to the control signal lines 156 and 157, respectively, as the control signal 157S has a voltage level "1", the CMOS transistor of the output part 106 is turned on, then the output part 106 outputs the driving potential VDD1 as a driving signal from the output terminal 160. (Refer to the waveform as indicated 160S in FIG. 2).

During t5, even when the control signals 117S to 119S are inputted to the control signal lines 117 to 119, respectively, the control signal 119S retains a voltage level "1", the selecting part 100 outputs the storage potential VDD4 to the selecting-part output line 170.

Next, even when the control signal 126S and 127S are inputted to the control signal lines 126 and 127, respectively, as the control signal 127S retains a voltage level "1", the output part 101 outputs the storage potential VDD4 from the output terminal 130. (Refer to the waveform as indicated 130S in FIG. 2).

On the other hand, when the control signal 147S to 149S are inputted to the control signal lines 147 to 149, respectively, as the control signal 148S has a voltage level "1", the CMOS transistor of the selecting part 105 is turned on, then the selecting part 105 outputs the storage potential VDD2 to the selecting-part output line 175.

Next, when the control signal 156S and 157S are inputted to the control signal lines 156 and 157, respectively, as the control signal 157S has a voltage level "1", then the output part 106 outputs the storage potential VDD2 as selected in the selecting part 105 from the output terminal 160. (Refer to the waveform as indicated 160S in FIG. 2).

During t6, when the control signals 117S to 119S are inputted to the control signal lines 117 to 119, respectively, as the control signal 117S has a voltage level "1", the P-type MOS transistor 110 is turned on, then the selecting part 100 outputs the driving potential VDD1 to the selecting-part output line 170.

Next, when the control signals 126S and 127S are inputted to the control signal lines 126 and 127, respectively, as the control signal 126S has a voltage level "1", the N-type MOS transistor 120 is turned on, then the output part 101 outputs the off potential VDD3 from the output terminal 130. (Refer to the waveform as indicated 130S in FIG. 2).

On the other hand, when the control signals 147S to 149S are inputted to the control signals 147 to 149, respectively, as the control signal 148S retains a voltage level "1", the selecting part 105 outputs the storage potential VDD2 to the selecting-part output line 175.

Next, when the control signals 156S and 157S are inputted to the control signal lines 156 and 157, respectively, as the control signal 157S has a voltage level "1", the output part 106 outputs the storage potential VDD2 from the output terminal 160. (Refer to the waveform as indicated 160S in FIG. 2).

During t7, when the control signals 117S to 119S are inputted to the control signal lines 117 to 119, respectively, as the control signal 119S has a voltage level "1", the N-type MOS transistor 113 is turned on, then the selecting part 100 outputs the storage potential VDD4 to the selecting-part output line 170.

Next, when the control signals 126S and 127S are inputted to the control signal lines 126 and 127, respectively, as the control signal 126S retains a voltage level "1", the output part 101 outputs the off potential VDD3 from the output terminal 130. (Refer to the waveform as indicated 130S in FIG. 2).

On the other hand, when the control signals 147S to 149S are inputted to the control signals 147 to 149, respectively, as the control signal 148S has a voltage level "1", the selecting part 105 outputs the storage potential VDD2 to the selecting-part output line 175.

Next, when the control signals 156S and 157S are inputted to the control signal lines 156 and 157, respectively, as the control signal 157S has a voltage level "1", the output part 106 outputs the storage potential VDD2 as selected in the selecting part 105 from the output terminal 160. (Refer to the waveform as indicated 160S in FIG. 2).

The above mentioned operations are to be repeated up until the n-th output terminal, thereby outputting the scanning signals to display one image on the liquid crystal display apparatus.

According to the following procedure liquid crystal in the liquid crystal display apparatus is twisted in the inverse direction so as to avoid a burning effect.

During t12, when the control signals 117S to 119S are inputted to the control signal lines 117 to 119, respectively, as the control signal 117S has a voltage level "1", the P-type MOS transistor 110 is turned on, then the selecting part 100 outputs the driving potential VDD1 to the selecting-part output line 170.

Next, when the control signals 126S and 127S are inputted to the control signal lines 126 and 127, respectively, as the control signal 127S has a voltage level "1", the CMOS transistor of the output part 101 is turned on, then the output part 101 outputs as a driving signal the driving potential VDD1 as obtained in the selecting part 100 from the output terminal 130. (Refer to the waveform as indicated 130S in FIG. 2).

On the other hand, when the control signals 147S to 149S are inputted to the control signals 147 to 149, respectively, as the control signal 149S has a voltage level "1", the N-type MOS transistor 143 is turned on, then the selecting part 105 outputs the storage potential VDD4 to the selecting-part output line 175.

Next, when the control signals 156S and 157S are inputted to the control signal lines 156 and 157, respectively, as the control signal 156S has a voltage level "1", the output part 106 outputs the off potential VDD3 from the output terminal 160. (Refer to the waveform as indicated 160S in FIG. 2).

During t13 when the control signals 117S to 119S are inputted to the control signal lines 117 to 119, respectively, as the control signal 118S has a voltage level "1", the CMOS transistor of the selecting part 100 is turned on, then the selecting part 100 outputs the storage potential VDD2 to the selecting-part output line 170.

Next, when the control signals 126S and 127S are inputted to the control signal lines 126 and 127, respectively, as the control signal 127S has a voltage level "1", the CMOS transistor of the output part 101 is turned on, then the output part 101 outputs the storage potential VDD2 as obtained in the selecting part 100 from the output terminal 130. (Refer to the waveform as indicated 130S in FIG. 2).

On the other hand, when the control signals 147S to 149S are inputted to the control signals 147 to 149, respectively, as the control signal 149S retains a voltage level "1", the selecting part 105 outputs the storage potential VDD4 to the selecting-part output line 175.

Next, even when the control signals 156S and 157S are inputted to the control signal lines 156 and 157, respectively, as the control signal 156S retains a voltage level "1", the output part 106 outputs the off potential VDD3 as a driving signal from the output terminal 160. (Refer to the waveform as indicated 160S in FIG. 2).

During t14, even when the control signals 117S to 119S are inputted to the control signal lines 117 to 119, respectively, as the control signal 118S retains a voltage level "1", the selecting-part 100 outputs the storage potential VDD2 to the selecting-part output line 170.

Next, when the control signals 126S and 127S are inputted to the control signal lines 126 and 127, respectively, as the control signal 127S has a voltage level "1", the CMOS transistor of the output part 101 is turned on, then the output part 101 outputs the storage potential VDD2 as obtained in the selecting part 100 from the output terminal 130. (Refer to the waveform as indicated 130S in FIG. 2).

On the other hand, when the control signals 147S to 149S are inputted to the control signals 147 to 149, respectively, as the control signal 147S has a voltage level "1", the P-type MOS transistor 140 is turned on, then the selecting part 105 outputs the driving potential VDD1 to the selecting-part output line 175.

Next, when the control signals 156S and 157S are inputted to the control signal lines 156 and 157, respectively, as the control signal 157S has a voltage level "1", the CMOS transistor of the output part 106 is turned on, then the output part 106 outputs the driving potential VDD1 as obtained in the selecting part 105 from the output terminal 160. (Refer to the waveform as indicated 160S in FIG. 2).

During t15, even when the control signals 117S to 119S are inputted to the control signal lines 117 to 119, respectively, as the control signal 118S retains a voltage level "1", the selecting part 100 outputs the storage potential VDD2 to the selecting-part output line 170.

Next, when the control signals 126S and 127S are inputted to the control signal lines 126 and 127, respectively, as the control signal 127S has a voltage level "1", the output part 101 outputs the storage potential VDD2 from the output terminal 130. (Refer to the waveform as indicated 130S in FIG. 2).

On the other hand, when the control signals 147S to 149S are inputted to the control signals 147 to 149, respectively, as the control signal 149S has a voltage level "1", the selecting part 105 outputs the storage potential VDD4 to the selecting-part output line 175.

Next, when the control signals 156S and 157S are inputted to the control signal lines 156 and 157, respectively, as the control signal 157S retains a voltage level "1", the CMOS transistor of the output part 106 is turned on, then the output part 106 outputs the storage potential VDD4 as selected in the selecting part 105 from the output terminal 160. (Refer to the waveform as indicated 160S in FIG. 2).

During t16, when the control signals 117S to 119S are inputted to the control signal lines 117 to 119, respectively, as the control signal 117S has a voltage level "1", the P-type MOS transistor 110 is turned on, then the selecting part 100 outputs the driving potential VDD1 to the selecting-part output line 170.

Next, when the control signals 126S and 127S are inputted to the control signal lines 126 and 127, respectively, as the control signal 126S has a voltage level "1", the output part 101 outputs the off potential VDD3 from the output terminal 130. (Refer to the waveform as indicated 130S in FIG. 2).

On the other hand, even when the control signals 147S to 149S are inputted to the control signals 147 to 149, respectively, as the control signal 149S retains a voltage level "1", the selecting part 105 outputs the storage potential VDD4 to the selecting-part output line 175.

Next, when the control signals 156S and 157S are inputted to the control signal lines 156 and 157, respectively, as the control signal 157S has a voltage level "1", the output part 106 outputs the storage potential VDD4 as obtained in the selecting part 105 from the output terminal 160. (Refer to the waveform as indicated 160S in FIG. 2).

During t17, when the control signals 117S to 119S are inputted to the control signal lines 117 to 119, respectively, as the control signal 118S has a voltage level "1", the CMOS transistor of the selecting part 100 is turned on, then the selecting part 100 outputs the storage potential VDD2 to the selecting-part output line 170.

Next, even when the control signals 126S and 127S are inputted to the control signal lines 126 and 127, respectively, as the control signal 126S retains a voltage level "1", then the output part 101 outputs the off potential VDD3 from the output terminal 130. (Refer to the waveform as indicated 130S in FIG. 2).

On the other hand, even when the control signals 147S to 149S are inputted to the control signals 147 to 149, respectively, as the control signal 149S retains a voltage level "1", the selecting part 105 outputs the storage potential VDD4 to the selecting-part output line 175.

Next, when the control signals 156S and 157S are inputted to the control signal lines 156 and 157, respectively, as the control signal 157S has a voltage level "1", the output part 106 outputs the storage potential VDD4 as obtained in the selecting part 105 from the output terminal 160. (Refer to the waveform as indicated 160S in FIG. 2).

The above mentioned operations are to be repeated up until the n-th output terminal, thereby outputting the scanning signals to display one image on the liquid crystal display.

As was elucidated by the above description, when observing each of the potentials in terms of timing, the potentials VDD1, VDD2 and VDD4 are those which have to be outputted at different times with one another from the n pieces of output terminals, while the potential VDD3 is allowed to be outputted at the same time as the n pieces of output terminals. Therefore, the driving circuit for the display apparatus according to the present invention is characterized in that after one out of potentials that are to be outputted at different times from n pieces of output terminals is selected, one out of said selected potential and a potential that is allowed to be outputted at the same time from said n pieces of output terminals is selected, thereafter eventually outputting signals from said n pieces of output terminals.

2. The Second Embodiment

Next, the principle applied to the second embodiment of the present invention will be explained. The second embodiment mitigates regulations on timing of the control signals, compared to the first embodiment.

Since the first embodiment is based on "a primary waveform is produced in the selecting part, and is thereafter cut down in the output parts ", a high precision of timing of cutting down is needed. (Refer to FIG. 2). Especially, in order to produce the waveform which is the subject matter of the present invention, timing between a potential (VDD 1), that follows after a potential (VDD3) that is to be outputted at the same time, and a subsequent potential (VDD4, or VDD2) has to be strict.

In the second embodiment of the present invention, therefore, the waveform is produced separately both in the selecting part and in the output parts so as to solve the timing problem.

Figure 3:
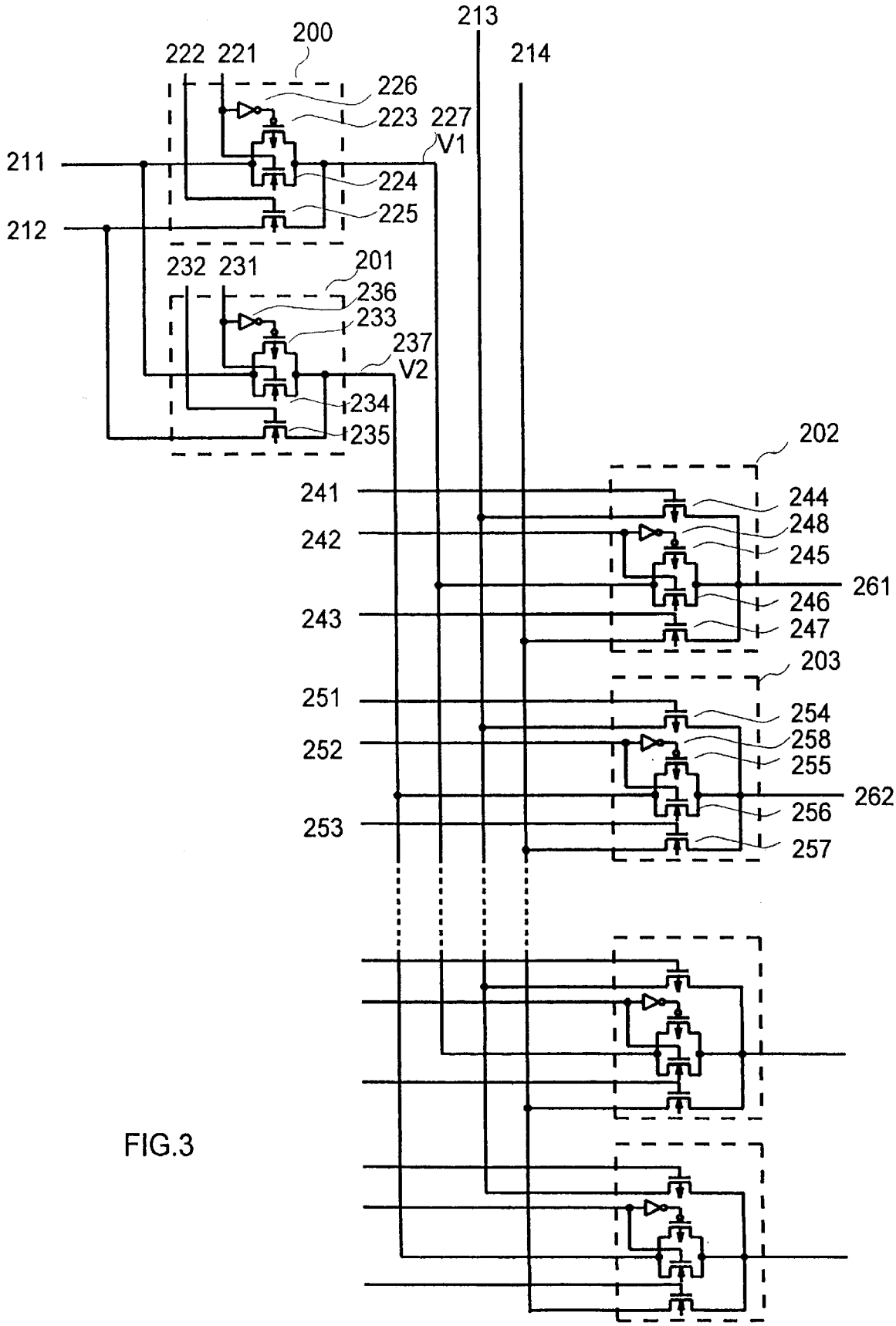
FIG. 3 shows a driving circuit realized by the second embodiment of the present invention.

FIG. 3 shows a driving circuit for the liquid crystal display apparatus with n pieces of output terminals according to the second embodiment of the present invention, comprising a plurality of selecting parts 200 and 201 and n pieces of output parts 202, 203 and so on for outputting a driving signal.

The supply potentials VDD1, VDD2, VDD3, VDD4 and VSS used in this embodiment hold the following relationship; VDD1 >VDD2>VDD3>VDD4>=VSS. Elements 211, 212, 213 and 214 are potential supply lines for potentials VDD2, VDD4, VDD1 and VDD3, respectively.

Each of the potentials VDD2 and VDD4 is to be outputted at different times from the output terminals as will be described later.

In other words, only these potentials which are to be outputted at different timing from the output terminals are to be inputted to the plurality of selecting parts.

The first selecting part 200 further comprises; potential supply lines 211 and 212, control signal lines 221 and 222, a P-type MOS transistors 223, N-type MOS transistors 224 and 225, an inverter 226, and a selecting-part output line 227. Here the P-type MOS transistor 223 and the N-type MOS transistor 224 are combined together to form a complementary circuit, what is called a CMOS structure.

In the similar way, the second selecting part 201 further comprises; the potential supply lines 211 and 212 that are in common use with the first selecting part 200, control signal lines 231 and 232, a P-type MOS transistors 233, N-type MOS transistors 234 and 235, an inverter 236, and a selecting-part output line 237. Here the P-type MOS transistor 233 and the N-type MOS transistor 234 are combined together to form a complementary circuit, called a CMOS structure. Here, potentials to be inputted to the potential supply lines 211 and 212 are to be eventually outputted at different timing from the output terminals of the output parts for a driving signal.

The operations of the selecting parts will be explained.

The first selecting part 200 outputs, by a control signal applied to the control signal line 221, a potential VDD2 on the potential supply line 211 to the selecting-part output line 227 as an output potential V1 from the first selecting part 200; or by a control signal applied to the control signal line 222, a potential VDD4 on the potential supply line 212 to the selecting-part output line 227 as an output potential V1 from the first selecting part 200.

In the same manner, the second selecting part 201 outputs, by a control signal applied to the control signal line 231, a potential VDD2 on the potential supply line 211 to the selecting-part output line 237 as an output potential V2 from the second selecting part; or by a control signal applied to the control signal line 232, a potential VDD4 on the potential supply line 212 to the selecting-part output line 237 as an output potential V2 from the second selecting part.

Since the n pieces of output parts are identical only the two output parts 202 and 203 will be explained below.

The output parts 202 comprises the output line 227 of the first selecting part 200, potential supply lines 213 and 214, control signal lines 241, 242 and 243, P-type MOS transistors 244 and 245, N-type MOS transistors 246 and 247, an inverter 248, and an output terminal 261. Here, the P-type MOS transistor 245 and the N-type MOS transistor 246 are combined together to form a complimentary circuit, called a CMOS structure.

In the same manner, the output parts 203 comprises the output line 237 of the second selecting part 201, the potential supply lines 213 and 214, control signal lines 251, 252 and 253, P-type MOS transistors 254 and 255, N-type MOS transistors 256 and 257, an inverter 258, and an output terminal 262. Here, the P-type MOS transistor 255 and the N-type MOS transistor 256 are combined together to form a complimentary circuit, called a CMOS structure.

As to the relation with the selecting parts, the odd numbered output parts have in common the output line 227 of the selecting part 200, while the even numbered output parts have in common the output line 237 of the second selecting part 201. Odd and even numbered output parts are the same in circuit construction excluding this part.

All output parts also have in common a potential supply line 213 by which VDD1 is supplied, and a potential supply line 214 by which VDD3 is supplied. Here, VDD3 is to be outputted from the output terminal at the same time with a potential as selected in the selecting part. In other words, the output part outputs either a potential (in case of FIG. 3, VDD3), which is to be outputted from the output terminal at the same time with a potential as selected in the selecting part, or a potential (in case of FIG. 3, either VDD2 or VDD4)as selected in the selecting part. By contrast, VDD1 is outputted next to a potential which is to be outputted at the same time.

The operation of the output part according to the second embodiment of the present invention will be explained.

The output part 202 outputs; by a control signal on the control signal line 241 the potential VDD1 on the potential supply line 213, by a control signal on the control signal line 242 the output potential V1 of the first selecting part 200, or by a control signal on the control signal line 243 the potential VDD3 on the potential supply line 214; from the output terminal 261.

In the same manner, the output part 203 outputs; by a control signal on the control signal line 251 the potential VDD1 on the potential supply line 213, by a control signal on the control signal line 252 the output potential V2 of the second selecting part 201, or by a control signal on the control signal line 253 the potential VDD3 on the potential supply line 214; from the output terminal 262.

In short, the odd numbered output parts are able to output an output potential V1 of the first selecting part 200 while the even numbered output parts are able to output an output potential V2 of the second output part 201.

Next, the operation of the liquid crystal driving circuit according to the second embodiment of the present invention will be explained, in sequence from one frame to the next, referring to FIGS. 3 and 4.

As will be evident, the waveform of an odd numbered output signal and that of an even numbered output signal are different in shape in the same frame, one having potentials VDD2 and the other having VDD4 and vice versa. The waveforms of an odd numbered and an even numbered output signals are exchanged in shape when shifting one frame to the next.

Figure 4:
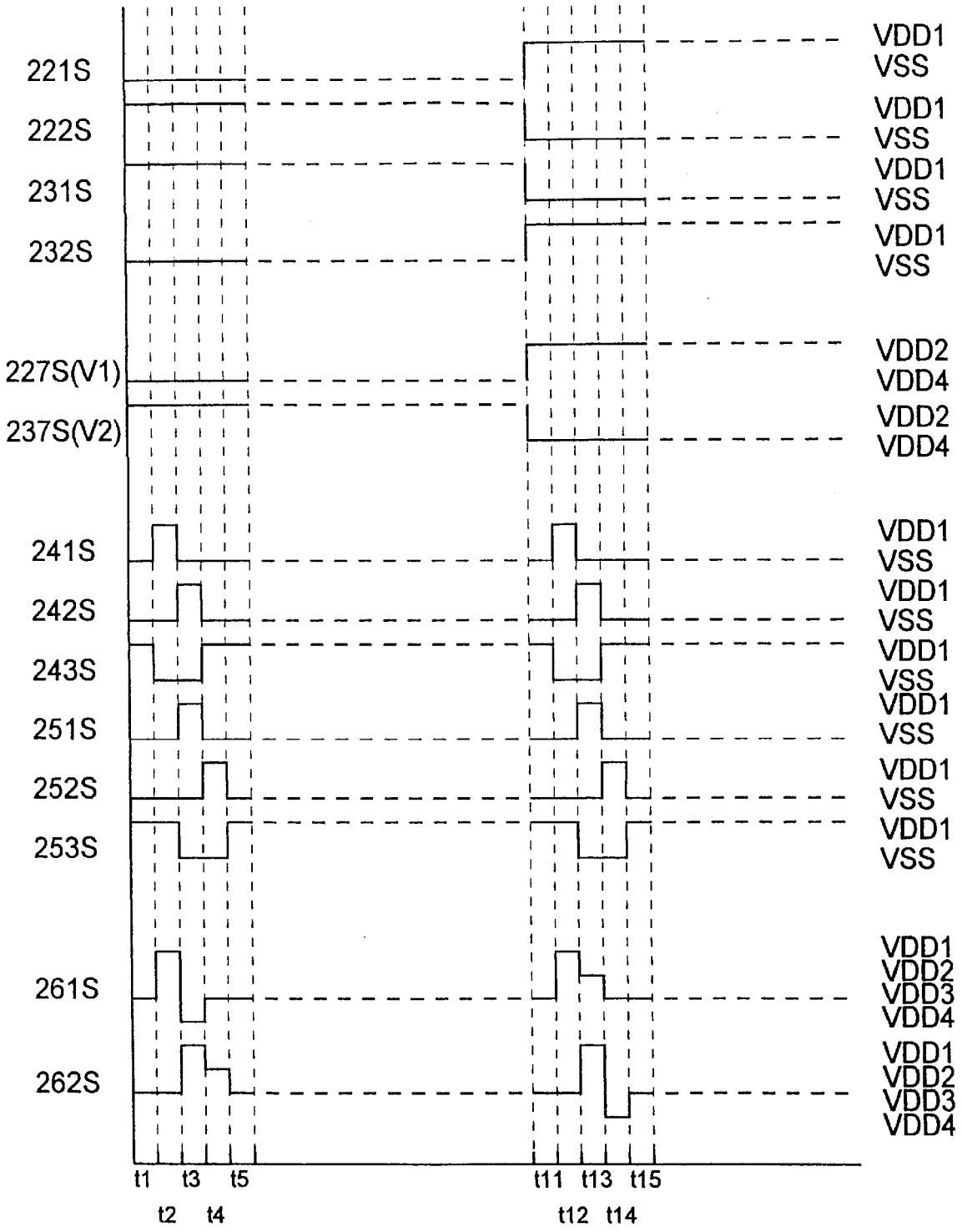
FIG. 4 is a timing chart for signals in a driving circuit realized by the second embodiment of the present invention.
Figure 5:
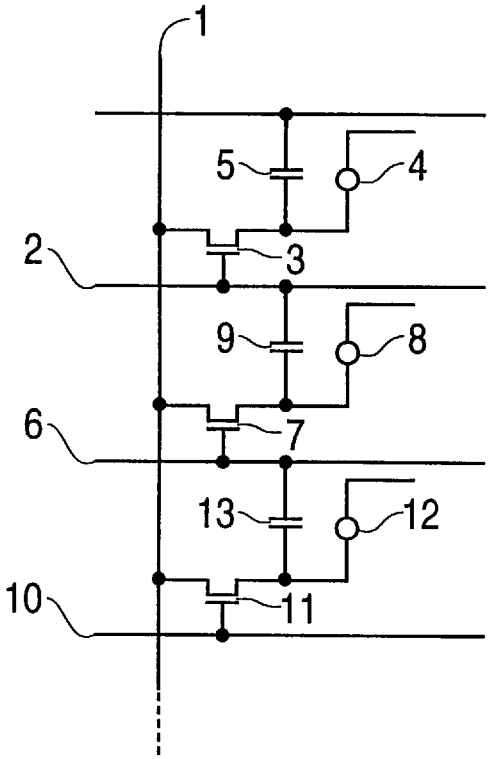
FIG. 5 (PRIOR ART)
FIG. 5 is a circuit diagram of a liquid crystal display apparatus.
Figure 6:
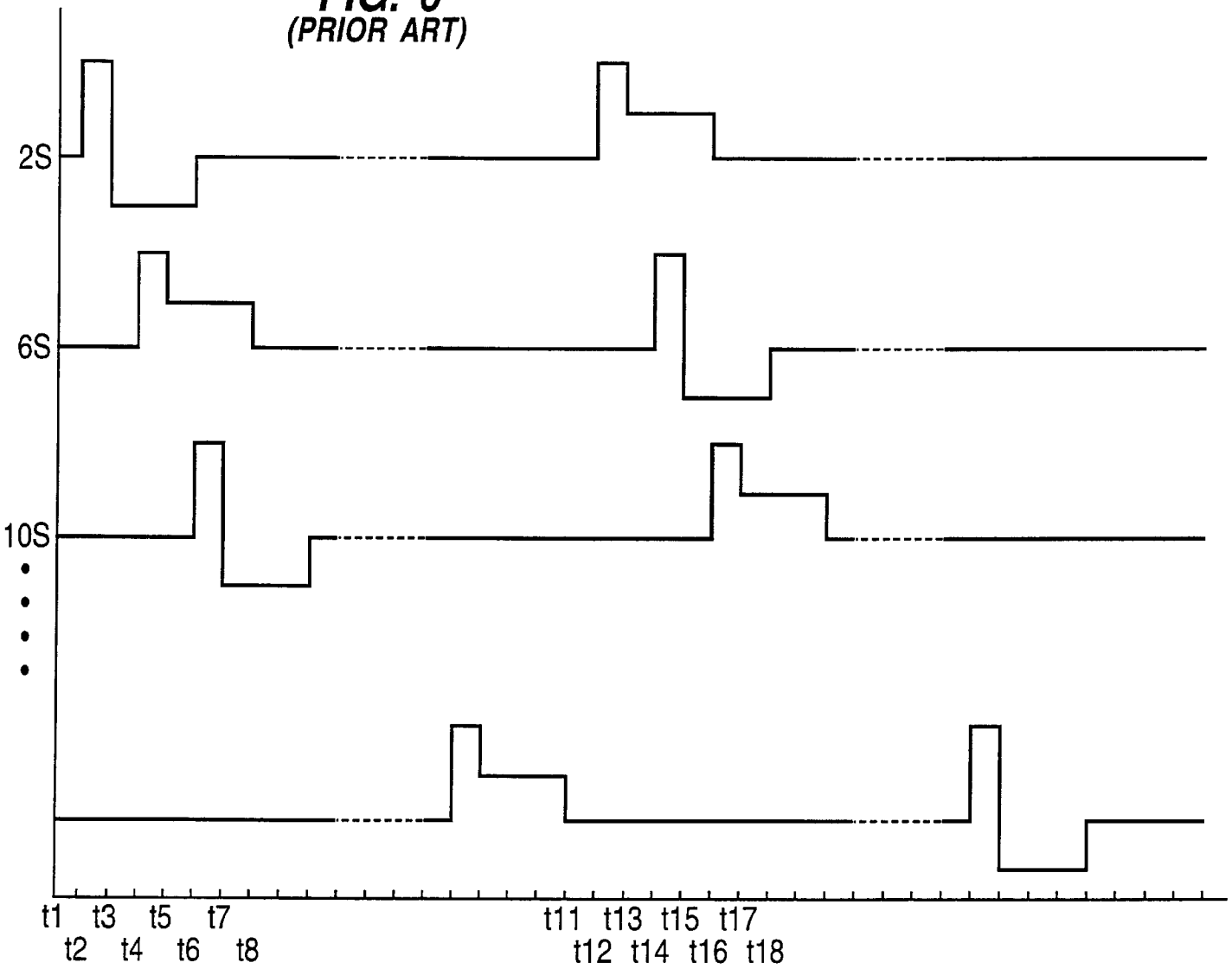
FIG. 6 (PRIOR ART)
FIG. 6 is a timing chart for scanning signals for the liquid crystal display apparatus of FIG. 5.
Figure 7:
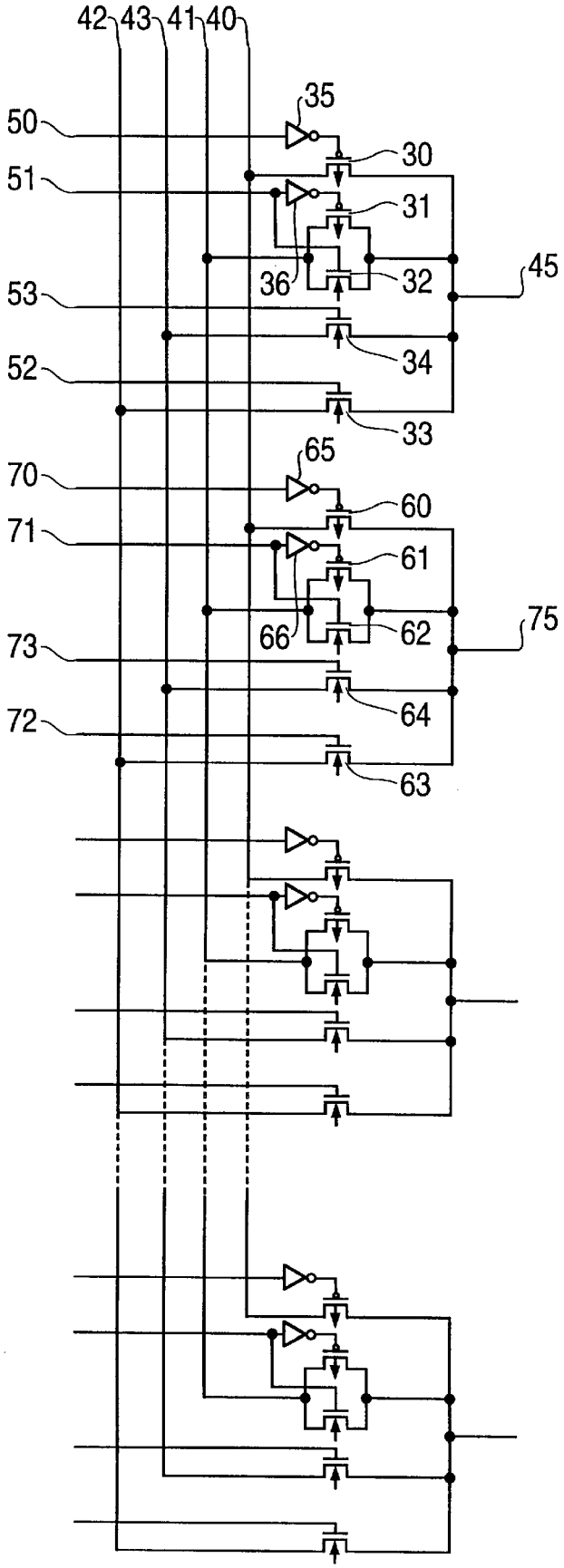
FIG. 7 (PRIOR ART)
FIG. 7 shows a conventional driving circuit for driving the liquid crystal display apparatus of FIG. 5.
Figure 8:
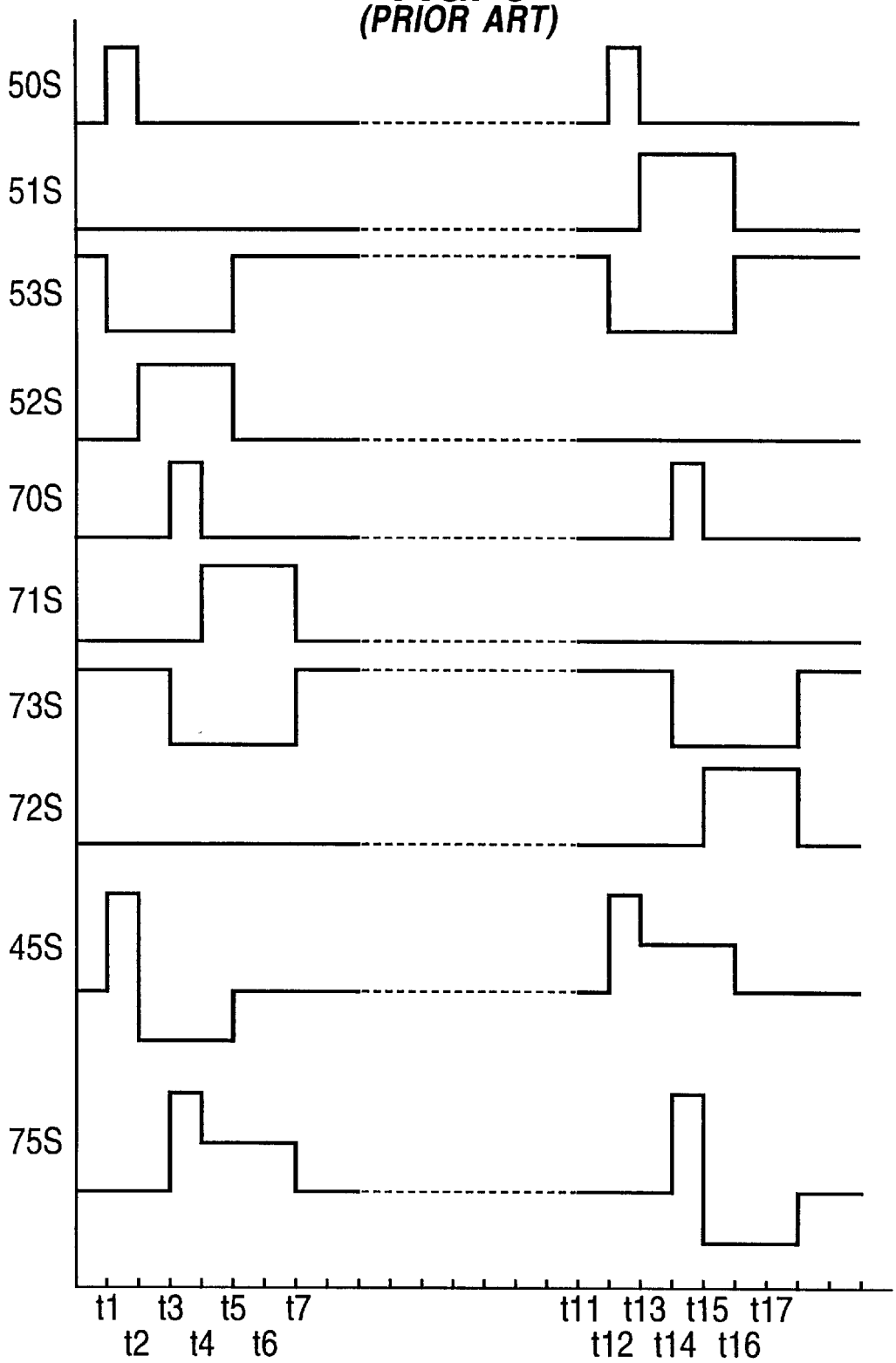
FIG. 8 (PRIOR ART)
FIG. 8 is a timing chart in the conventional driving circuit of FIG. 7.

FIG. 4 is a timing chart representing the operation of the liquid crystal driving circuit as shown in FIG. 3.

Elements 221S, 222S, 231S, 2342S, 241S, 242S, 243S, 251S, 252S and 253S denote control signals applied to the control signal lines 221, 222, 231, 232, 241, 242, 243, 251, 252 and 253, respectively; elements 227S (V1) and 237S (V2) are output potential of selecting-part output lines of 227 and 237 respectively; and 261S and 262S denote driving signals as outputted from the output terminals 261 and 262, respectively.

During one frame beginning with t1 (the next frame begins with t11), as a control signal 221S of the first selecting part 200 retains VSS and a control signal 222S retains VDD1, the potential VDD4 on the potential supply line 212 is selected and then is outputted as an output potential V1 to the selecting-part output line 227. In short, the odd numbered output parts are able to output VDD4 but not VDD2.

In the same manner, during the same frame, in the second selecting part 201 the potential VDD2 on the potential supply line 211 is selected, then the even numbered output parts are able to output VDD2 but not VDD4.

When shifting to the next frame beginning with t11, the control signals 221S, 222S, 231S and 2342S are inverted. Therefore, during the period of this frame, the odd numbered output parts are able to output VDD2 but not VDD4, while the even numbered output parts are able to output VDD4 but not VDD2.

During t1 being in the state of stand-by, as the control signals 243S and 253S are turned on, the off potential VDD3 is outputted from the all output terminals 261, 262 and so on.

During t2, as the potentials of the control signals 242S and 243S are VSS and the potential of the control signal 241 is VDD1, the P-type MOS transistor 244 is turned on, then the potential VDD1 on the potential supply line 213 is outputted as a driving signal from the output terminal 261.

At the same time, as the potentials of the control signals 251S and 252S are VSS and the potential of the control signal 253S is VDD1, the N type MOS transistor 257 is turned on, then the potential VDD3 on the potential supply line 214 is outputted as a driving signal from the output terminal 262.

During t3, as the potentials of the control signals 241S and 243S are VSS and the potential of the control signal 242S is VDD1, the CMOS transistor of the output part 202 is turned on, then the potential V1 as selected in the first selecting part is outputted as a driving signal from the output terminal 261.

At the same time, as the potentials of the control signals 252S and 253S are VSS and the potential of the control signal 251S is VDD 1, the P type MOS transistor 254 is turned on, then the potential VDD1 is outputted as a driving signal from the output terminal 262.

During t4, as the potentials of the control signals 241S and 242S are VSS and the potential of the control signal 243S is VDD1, the N type MOS transistor 247 is turned on, then the potential VDD3 on the potential supply line 214 is outputted as a driving signal from the output terminal 261.

At the same time, as the potentials of the control signals 251S and 253S are VSS and the potential of the control signal 252S is VDD1, the CMOS transistor of the output part 203 is turned on, then the potential VDD2 as selected in the second selecting part 201 is outputted as a driving signal from the output terminal 262.

During t5, as the potentials of the control signals 241S and 242S are VSS and the potential of the control signal 243S is VDD1, the N type MOS transistor 247 is turned on, then the potential VDD3 on the potential supply line 214 is outputted as a driving signal from the output terminal 261.

At the same time, as the potentials of the control signals 251S and 252S are VSS and the potential of the control signal 253S is VDD1, the N type MOS transistor 257 is turned on, then the potential VDD3 on the potential supply line 214 is outputted as a driving signal from the output terminal 262.

In the same manner as described above, driving signals are successively outputted and go into the state of stand-by, thus terminating this frame.

When shifting to the next frame, t11 is in the state of stand-by, then the off potentials VDD3 are outputted from the all the output terminals 261, 262 and so on.

During t12, as the potentials of the control signals 242S and 243S are VSS and the potential of the control signal 241S is VDD1, the P type MOS transistor 244 is turned on, then the potential VDD1 on the potential supply line 213 is outputted as a driving signal from the output terminal 261.

At the same time, as the potentials of the control signals 251S and 252S are VSS and the potential of the control signal 253S is VDD1, the N type MOS transistor 257 is turned on, then the potential VDD3 on the potential supply line 214 is outputted as a driving signal from the output terminal 262.

During t13, as the potentials of the control signals 241S and 243S are VSS and the potential of the control signal 242S is VDD1, the CMOS transistor of the output part 202 is turned on, then the output potential VDD2 of the first selecting part is outputted as a driving signal from the output terminal 261.

At the same time, as the potentials of the control signals 252S and 253S are VSS and the potential of the control signal 251S is VDD1, the P type MOS transistor 254 is turned on, then the potential VDD1 on the potential supply line 213 is outputted as a driving signal from the output terminal 262.

During t14, as the potentials of the control signals 241S and 242S are VSS and the potential of the control signal 243S is VDD1, the N type MOS transistor 247 is turned on, the potential VDD3 on the potential supply line 214 is turned on, then the potential VDD3 on the potential supply line 214 is outputted as a driving signal from the output terminal 261.

At the same time, as the potentials of the control signals 251S and 253S are VSS, and the potential of the control signal 252S is VDD1, the CMOS transistor of the output part 203 is turned on, then the output potential VDD4 of the second selecting part 201 is outputted from the output terminal 262.

During t15, as the potentials of the control signals 241S and 242S are VSS and the potential of the control signal 243S is VDD1, the N type MOS transistor 247 is turned on, then the potential VDD3 on the potential supply line 214 is outputted as a driving signal from the output terminal 261.

At the same time, as the potentials of the control signals 251S and 252S are VSS and the potential of the control signal 253S is VDD1, the N type MOS transistor 257 is turned on, then the potential VDD3 on the potential supply line 214 is outputted as a driving signal from the output terminal 262.

As is understood from the above explanation, the potentials VDD1, VDD2 and VDD4 are to be outputted at different times with one another from the n pieces of output terminals, the potential VDD3 is to be outputted at the same time from the n pieces of output terminals, and above all the potential VDD1 is to be outputted next to a potential to be outputted at the same time.

Expressing in another way in accordance to the second embodiment of the present invention, the driving circuit for the display apparatus is characterized in that; one potential (namely, either VDD2 or VDD4)is selected out of potentials (namely, VDD 1, VDD2 and VDD4)that are to be outputted at different times at the n pieces of output terminals excluding potentials that are to be outputted next to a potential (namely, VDD1) that are to be outputted at the same time at the n pieces of output terminals;

and thereafter, the next potential is selected, among said selected potential (namely, either VDD2 or VDD4), said potential (namely, VDD3) that are to be outputted at the same time from the n pieces of output terminals, and said potential (namely, VDD1) that are to be outputted next to the potential that are to be outputted at the same time from the n pieces of output terminals;

thereby outputting the driving signals from the n pieces of output terminals.

As described in the above mentioned embodiments, a liquid crystal driving circuit according to the present invention is realized that has the same function and operation as a conventional liquid crystal driving circuit with a significantly reduced transistor count.

To speak concretely, the conventional driving circuit needs 9 transistors for one output part while the driving circuit according to the first embodiment of the present invention needs only 5, thereby eliminating 4.

In case of a liquid crystal driving circuit, say, with 240 output terminals, the conventional one needs 240×9=2,160 transistors. By contrast, the driving circuit according to the first embodiment of the present invention needs, taking into account a transistor count in the first and second selecting part, 240×5+2×8=1,216 transistors saving 944, thus substantially reducing the necessary chip area.

The other driving circuit according to the second embodiment of the present invention needs only 6 transistors for one output part, saving 3. In case of a liquid crystal driving circuit with 240 output terminals, the driving circuit needs 240×6+2×5=1,450 transistors saving 710, thus also substantially reducing the necessary chip area.

The driving circuit realized by the second embodiment, furthermore, has a large allowance for timing lags in the control signals, thereby ensuring the stable operation of the circuit.

In the preferred embodiments as described above, MOS transistors are employed, but other elements having switching function might well be employed, using other than the waveforms of control signals used in the preferred embodiments.

What is claimed is:

1. A driving circuit for a display apparatus, said driving circuit comprising:

m selecting parts, each selecting part operative for selecting one potential out of a plurality of first predetermined potentials and for outputting said selected first predetermined potential, and n output parts, each output part operative for selecting and outputting either a selected first predetermined potential output by one of said m selecting parts or a second predetermined potential, said second predetermined potential being from a source other than said m selecting parts, said plurality of first predetermined potentials being output from said output parts at different times from one another, wherein m and n are integers and n is greater than m.

2. A driving circuit for a display apparatus having m selecting parts and n output terminals, each of n output terminals for outputting a driving signal comprising a plurality of potentials, wherein:

one potential is selected out of first potentials that are to be outputted at different times by said n output terminals, said first potentials being output by said m selecting parts ;

and thereafter one potential is selected out of said first potentials and a second potential that is to be outputted at the same time by said n output terminals, and then outputted, said second potential being from a source other than said m selecting parts.

3. A driving method for a display apparatus having m selecting parts and n output terminals, each of n output terminals for outputting a driving signal comprising a plurality of potentials, wherein:

one potential is selected out of first potentials that are to be outputted at different times by said n output terminals, said first potentials being output by said m selecting parts;

and thereafter one potential is selected out of said first potentials and a second potential that is to be outputted at the same time by said n output terminals, and then outputted, said second potential being from a source other than said m selecting parts.

4. A driving circuit for a display apparatus having n output terminals each for outputting a driving signal comprising a plurality of potentials, said driving circuit comprising:

a first and second selecting part, each of which is operative for selecting one potential out of a plurality of potentials that are to be outputted at different times;

and n output parts, each of which is operative for selecting one potential out of said selected potential and a second potential that is to be outputted at the same time by said n output terminals, said second potential being from a source other than said first and second selecting part.

5. A driving circuit for a display apparatus having m selecting parts, and n output terminals, each of n output terminals for outputting a driving signal comprising a plurality of potentials, said n output terminals having odd numbered output terminals and even numbered output terminals, wherein:

a first potential is selected as an odd numbered potential and a second potential is selected as an even numbered potential out of potentials that are to be outputted at different times between the odd numbered output terminals and between the even numbered output terminals, respectively of said n output terminals, said first potential and second potential being output by said m selecting parts;

and one potential is selected out of said selected odd numbered potential and a third potential that is to be outputted at the same time by the odd numbered output terminals, and one potential is selected out of said selected even numbered potential and a fourth potential that is to be outputted at the same time by the even numbered output terminals, respectively, of said n output terminals, said third potential and said fourth potential being from a source other than said m selecting parts.

6. A driving method for a display apparatus having n output terminals each for outputting a driving signal comprising a plurality of potentials, said n output terminals having odd numbered output terminals and even numbered output terminals, wherein:

a first potential is selected as an odd numbered potential and a second potential is selected as an even numbered potential out of potentials that are to be outputted at different times between the odd numbered output terminals and between the even numbered output terminals, respectively of said n output terminals, said first potential and second potential being output by said m selecting parts;

and one potential is selected out of said selected odd numbered potential and a third potential that is to be outputted at the same time by the odd numbered output terminals, and one potential is selected out of said selected even numbered potential and a fourth potential that is to be outputted at the same time by the even numbered output terminals, respectively, of said n output terminals, said third potential and said fourth potential being from a source other than said m selecting parts.

7. A driving circuit for a display apparatus having n output terminals each for outputting a driving signal comprising a plurality of potentials, said n output terminals having odd numbered output terminals and even numbered output terminals, said driving circuit comprising:

a first selecting part wherein one potential is selected out of potentials that are to be outputted at different times between the odd numbered output terminals;

a second selecting part wherein one potential is selected out of potentials that are to be outputted at different times between the even numbered output terminals;

n/2 first output parts, each of said first output parts operative for selecting one potential out of said selected potential in said first selecting part and a second potential that is to be outputted at the same time from the odd numbered output terminals, and then outputting said selected potential from said odd numbered output terminals, said second potential being from a source other than said first selecting part;

and n/2 second output parts, each of said second output parts operative for selecting one potential out of said selected potential in said second selecting part and a third potential that is to be outputted at the same time from the even numbered output terminals, and then outputting said selected potential from said even numbered output terminals, said third potential being from a source other than said first selecting part.

8. A driving circuit for a display apparatus having n output terminals each for outputting a driving signal comprising a driving potential, a first storage potential, a second storage potential and an off potential, said driving circuit comprising:

a first and second selecting part, each of which is operative for selecting one potential out of said driving potential, said first storage potential and said second storage potential;

and n output parts, each of which is operative for selecting one potential out of said selected potential and said off potential, said off potential being from a source other than said first second selecting part.

9. A driving circuit for a display apparatus comprising:

a first selecting part comprising, a first transfer gate for outputting a first potential in accordance with a first control signal, a second transfer gate for outputting a second potential in accordance with a second control signal, and a third transfer gate for outputting a third potential in accordance with a third control signal;

a second selecting part comprising, a fourth transfer gate for outputting said first potential in accordance with a fourth control signal, a fifth transfer gate for outputting said second potential in accordance with a fifth control signal, and a sixth transfer gate for outputting a third potential in accordance with a sixth control signal;

a plurality of first output parts having in common two inputs, said common inputs include the output potential of said first selecting part and a fourth potential, said fourth potential being from a source other than said first selecting part or said second selecting part; each of said first output parts further comprising, a seventh transfer gate for outputting said output potential from said first selecting part in accordance with a seventh control signal, and an eighth transfer gate for outputting said fourth potential in accordance with an eighth control signal;

and a plurality of second output parts having in common two inputs, said common inputs include the output potential of said second selecting part and a fifth potential, said fifth potential being from a source other than said first selecting part or said second selecting part; each of said second output parts further comprising, a ninth transfer gate for outputting said output potential from said second selecting part in accordance with a ninth control signal, and a tenth transfer gate for outputting said fifth potential in accordance with a tenth control signal.

10. A driving circuit for a display apparatus having at least one selecting part, and n output terminals, each of n output terminals for outputting a driving signal comprising a plurality of potentials, wherein:

one potential is selected out of potentials that are to be outputted at different times from said n output terminals, excluding potentials that are to be outputted next to the potential to be outputted at the same time from said n output terminals, said one potential being output by said selecting part;

and thereafter one potential is selected out of said selected potential, potentials that are to be outputted at the same time from said n output terminals, and potentials that are to be outputted next to the potential to be outputted at the same time from said n output terminals, said potentials to be output at the same time being from a source other than said selecting part.

11. A driving method for a display apparatus having having at least one selecting part, and n output terminals, each of n output terminals for outputting a driving signal comprising a plurality of potentials, wherein:

one potential is selected out of potentials that are to be outputted at different times from said n output terminals, excluding potentials that are to be outputted next to the potential to be outputted at the same time from said n output terminals, said one potential being output by said selecting part;

and thereafter one potential is selected out of said selected potential, potentials that are to be outputted at the same time from said n output terminals, and potentials that are to be outputted next to the potential to be outputted at the same time from said n output terminals, said potentials to be output at the same time being from a source other than said selecting part.

12. A driving circuit for a display apparatus having n output terminals each for outputting a driving signal comprising a plurality of potentials, said driving circuit comprising:

a first and second selecting part, each of which is operative for selecting one potential out of potentials that are to be outputted at different times from said n output terminals, excluding a potential that is to be outputted next to the potentials to be outputted at the same time from said n output terminals;

and n pieces of output parts, each of which is operative for selecting one potential out of said selected potential, potentials that are to be outputted at the same time from said n output terminals, and potentials that are to be outputted next to the potential to be outputted at the same time from said n output terminals, said potentials to be output at the same time being from a source other than said first selecting part or said second selecting part.

13. A driving circuit for a display apparatus having at least one selecting part and n output terminals, each of n output terminals for outputting a driving signal comprising a plurality of potentials, said n output terminals having odd numbered output terminals and even numbered output terminals, wherein:

one potential output by said selecting part is selected as an odd numbered potential and one potential output by said selecting part is selected as an even numbered potential out of potentials that are to be outputted at different times between the odd numbered output terminals and between the even numbered output terminals, respectively, of said n output terminals, excluding potentials that are to be outputted next to the potential to be outputted at the same time from the n output terminals;

and thereafter, one potential is selected out of said odd numbered potential, potentials that are to be outputted at the same time from the odd numbered output terminals, and potentials to be outputted next to the potential to be outputted at the same time from the odd numbered output terminals, said potential to be output at the same time being from a source other than said selecting part; and said even numbered potential, potentials that are to be outputted at the same time from the even numbered output terminals, and potentials that are to be outputted next to the potentials to be outputted at the same time from the even numbered output terminals respectively, said potential to be output at the same time being from a source other than said selecting tart.

14. A driving method for a display apparatus having at least one selecting part and n output terminals, each of n output terminals for outputting a driving signal comprising a plurality of potentials, said n output terminals having odd numbered output terminals and even numbered output terminals, wherein:

one potential output by said selecting part is selected as an odd numbered potential and one potential output by said selecting part is selected as an even numbered potential out of potentials that are to be outputted at different times between the odd numbered output terminals and between the even numbered output terminals, respectively, of said n output terminals, excluding potentials that are to be outputted next to the potential to be outputted at the same time from the n output terminals;

and thereafter, one potential is selected out of said odd numbered potential, potentials that are to be outputted at the same time from the odd numbered output terminals, and potentials to be outputted next to the potential to be outputted at the same time from the odd numbered output terminals, said potential to be output at the same time being from a source other than said selecting part; and said even numbered potential, potentials that are to be outputted at the same time from the even numbered output terminals, and potentials that are to be outputted next to the potentials to be outputted at the same time from the even numbered output terminals respectively, said potential to be output at the same time being from a source other than said selecting part.

15. A driving circuit for a display apparatus having n output terminals each for outputting a driving signal comprising a plurality of potentials, said n output terminals having odd numbered output terminals and even numbered output terminals, said driving circuit comprising:

a first selecting part wherein one potential is selected out of potentials that are to be outputted at different times from the odd numbered output terminals, excluding potentials that are to be outputted next to the potential to be outputted at the same time from the odd numbered output terminals;

a second selecting part wherein one potential is selected out of potentials that are to be outputted at different times from the even numbered output terminals, excluding potential that are to be outputted next to the potential to be outputted at the same time from the even numbered output terminals;

n/2 pieces of first output parts wherein one potential is selected out of said selected potential in said first selecting part, potentials that are to be outputted at the same time from the odd numbered output terminals, and potentials that are to be outputted next to the potential to be outputted at the same time from said odd numbered output terminals, said potentials to be output at the same time being from a source other than said first selecting part or said second selecting part;

and n/2 pieces of second output parts wherein one potential is selected out of said selected potential in said second selecting part, potentials that are to be outputted at the same time from the even numbered output terminals, and potentials that are to be outputted next to the potential to be outputted at the same time from said even numbered output terminal, said potentials to be output at the same time being from a source other than said first selecting part or said second selecting part.

16. A driving circuit for a display apparatus having n output terminals each for outputting a driving signal comprising a driving potential, a first storage potential, a second storage potential and an off potential, said driving circuit comprising:

a first and second selecting part, each of which is operative or selecting one potential out of said first storage potential and said second storage potential;

and n output parts, each of which is operative for selecting one potential out of said selected potential in said selecting parts, said driving potential, and said off potential, and outputting said selected potential from said output terminal, said driving potential being from a source other than said first and second selecting part.

17. A driving circuit for a display apparatus, said driving circuit comprising:

a first selecting part comprising a first transfer gate for outputting a first potential in accordance with a first control signal, and a second transfer gate for outputting a second potential in accordance with a second control signal;

a second selecting part comprising a third transfer gate for outputting a first potential in accordance with a third control signal, and a fourth transfer gate for outputting a second potential in accordance with a fourth control signal;

a plurality of first output parts having in common three inputs, said three inputs including the output of said first selecting part, a third potential, and a fourth potential;

each of said first output parts further comprising a fifth transfer gate for outputting the output of said first selecting part in accordance with a fifth control signal, a sixth transfer gate for outputting said third potential in accordance with a sixth control signal, and a seventh transfer gate for outputting said fourth potential in accordance with a seventh control signal, said third potential being from a source other than said plurality of first output parts;

and a plurality of second output parts having in common three inputs, said three inputs including the output of said second selecting part, said third potential, and said fourth potential;

each of said second output parts further comprising an eighth transfer gate for outputting the output of said second selecting part in accordance with an eighth control signal, a ninth transfer gate for outputting said third potential in accordance with a ninth control signal, said third potential being from a source other than said plurality of second output parts, and a tenth transfer gate for outputting said fourth potential in accordance with a tenth control signal.

* * * * *